US005782334A

United States Patent [19]

Parrocchetti et al.

[11] Patent Number: 5,782,334

[45] Date of Patent: Jul. 21, 1998

[54] METHOD AND LINE FOR FORMING AND CONVEYING ORDERLY GROUPS OF ELONGATED PRODUCTS, PARTICULARLY CIGARETTES

[75] Inventors: Gian Paolo Parrocchetti, Bologna; Claudio Mistroni, Zola Predosa; Antonio Gamberini, Bologna, all of Italy

[73] Assignee: G.D Societa' Per Azioni, Bologna, Italy

[21] Appl. No.: 590,170

[22] Filed: Jan. 23, 1996

[30] Foreign Application Priority Data

Jan. 26, 1995 [IT] Italy ..... B095A0021

[51] Int. Cl.[6] ..... B65G 47/26

[52] U.S. Cl. ..... 198/418.3; 198/418.1

[58] Field of Search ..... 198/418.1, 418.2, 198/418.3, 418.4, 803.14; 53/149, 150, 151, 444

[56] References Cited

U.S. PATENT DOCUMENTS

| | | | |
|---|---|---|---|
| 2,334,142 | 11/1943 | Arelt | 226/5 |
| 3,241,289 | 3/1966 | Molins | 53/151 X |
| 4,306,648 | 12/1981 | Manservisi et al. | 198/418.3 |
| 4,362,235 | 12/1982 | Erdmann | 198/418.3 |
| 4,700,825 | 10/1987 | Mattei et al. | 198/418.3 |
| 5,548,941 | 8/1996 | Portaro et al. | 198/418.1 X |

FOREIGN PATENT DOCUMENTS

| | | | |
|---|---|---|---|
| 0 142 803 A1 | 5/1985 | European Pat. Off. . | |
| 592 965 | 8/1925 | France . | |
| 0678071 | 7/1939 | Germany | 53/147 |

*Primary Examiner*—James R. Bidwell

*Attorney, Agent, or Firm*—Marshall, O'Toole, Gerstein, Murray & Borun

[57] ABSTRACT

A method and line for forming and conveying orderly groups of elongated products, particularly cigarettes, whereby each group is formed of a number of superimposed layers of products arranged side by side and separated by a given distance less than the width of the product and such as to compensate for the absence of at least one product in each of the layers each group being formed by feeding the relative layers axially and successively into a forming spindle, at least the bottom wall of which presents seats separated by the aforementioned given distance and for receiving and transversely retaining in position the products in a first layer; and each pair of adjacent products in one layer defining a seat for transversely retaining in position a product in an upper layer.

25 Claims, 6 Drawing Sheets

P1

XI
XI

METHOD AND LINE FOR FORMING AND CONVEYING ORDERLY GROUPS OF ELONGATED PRODUCTS, PARTICULARLY CIGARETTES

BACKGROUND OF THE INVENTION

The present invention relates to a method of forming and conveying orderly groups of elongated products, particularly cigarettes.

The present invention may be applied to advantage to the packaging of cigarettes, to which the following description refers purely by way of example.

In the tobacco industry, packets of cigarettes are formed, each containing an orderly group of cigarettes arranged quincuncially in maximum-density manner to occupy as much of the available space as possible inside the packet and so achieve maximum stability of the group.

For various reasons, however, it is sometimes necessary to reduce the number of cigarettes defining the group in each packet, while at the same time maintaining substantially the same size of the packet, which therefore poses the problem of maintaining a stable shape of the group to prevent the cigarettes from moving and so being damaged inside the packet.

In the past, the above problem has been solved by forming groups comprising a predetermined number of real cigarettes, to which dummy cigarettes, normally consisting of filters, are added in such a number as to maintain the maximum density of the group. Alternatively, the inner volume of the packet is reduced in proportion to the number of missing cigarettes, by forming box bodies inside it, normally by folding a portion of a collar inside the packet.

Both the above solutions present the drawback of being expensive and difficult to put into practice.

SUMMARY OF THE INVENTION

It is an object of the present invention to provide a straightforward, low-cost method of forming and conveying groups of cigarettes of relatively highly stable shape and, at the same time, relatively low density.

According to the present invention, there is provided a method of forming and conveying orderly groups of elongated products, particularly cigarettes, the method comprising the steps of forming a said group by confining a number of superimposed layers of products inside a given volume, and feeding said volume to wrapping means in a given supply direction; characterized in that each layer comprises a number of products arranged, inside said volume, in an orderly operating arrangement wherein the products in each layer are arranged side by side and separated by a given distance greater than zero and less than the width of the product; each pair of adjacent products in each layer defining a seat for a product in each adjacent layer.

The above method preferably also comprises the further step of transversely retaining, in said operating arrangement, the products in at least one outer layer of the group inside said given volume.

The above method also preferably comprises the further step of compressing each group inside said given volume in a direction crosswise to the layers, and in a direction parallel to the layers and crosswise to the products.

According to a preferred embodiment of the method according to the present invention, each said group is formed by feeding the layers axially, and preferably successively, into a forming spindle defining said given volume; the spindle presenting a bottom wall in turn presenting seats separated by said given distance and for receiving and transversely retaining in position the products of a first said layer.

The present invention also relates to a line for forming and conveying orderly groups of elongated products.

According to the present invention, there is provided a line for forming and conveying orderly groups of elongated products, particularly cigarettes, the line comprising at least a first conveyor traveling in a given supply direction towards wrapping means and in turn presenting pockets, each defining a given volume for accommodating a said group, each group comprising a number of superimposed layers of products; and supply means for feeding the layers in each said group into the relative said volume; characterized in that each said pocket presents retaining means for transversely retaining the products of at least one said layer inside the relative said volume and in an operating arrangement wherein the products in each layer are arranged side by side and separated by a given distance greater than zero and less than the width of the product; each pair of adjacent products in said operating arrangement defining, in use, a seat for a product in each adjacent layer.

The above line preferably also comprises compressing means for compressing each group inside said given volume in a direction crosswise to the layers, and in a direction parallel to the layers and crosswise to the products.

According to a preferred embodiment of the line according to the present invention, said supply means comprise thrust means for feeding the layers in each said group axially, and preferably successively, into a respective said pocket; each pocket being defined by a forming spindle in turn defining said given volume; and the spindle presenting a bottom wall in turn presenting seats separated by said given distance and for receiving and transversely retaining in position the products in a first said layer.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
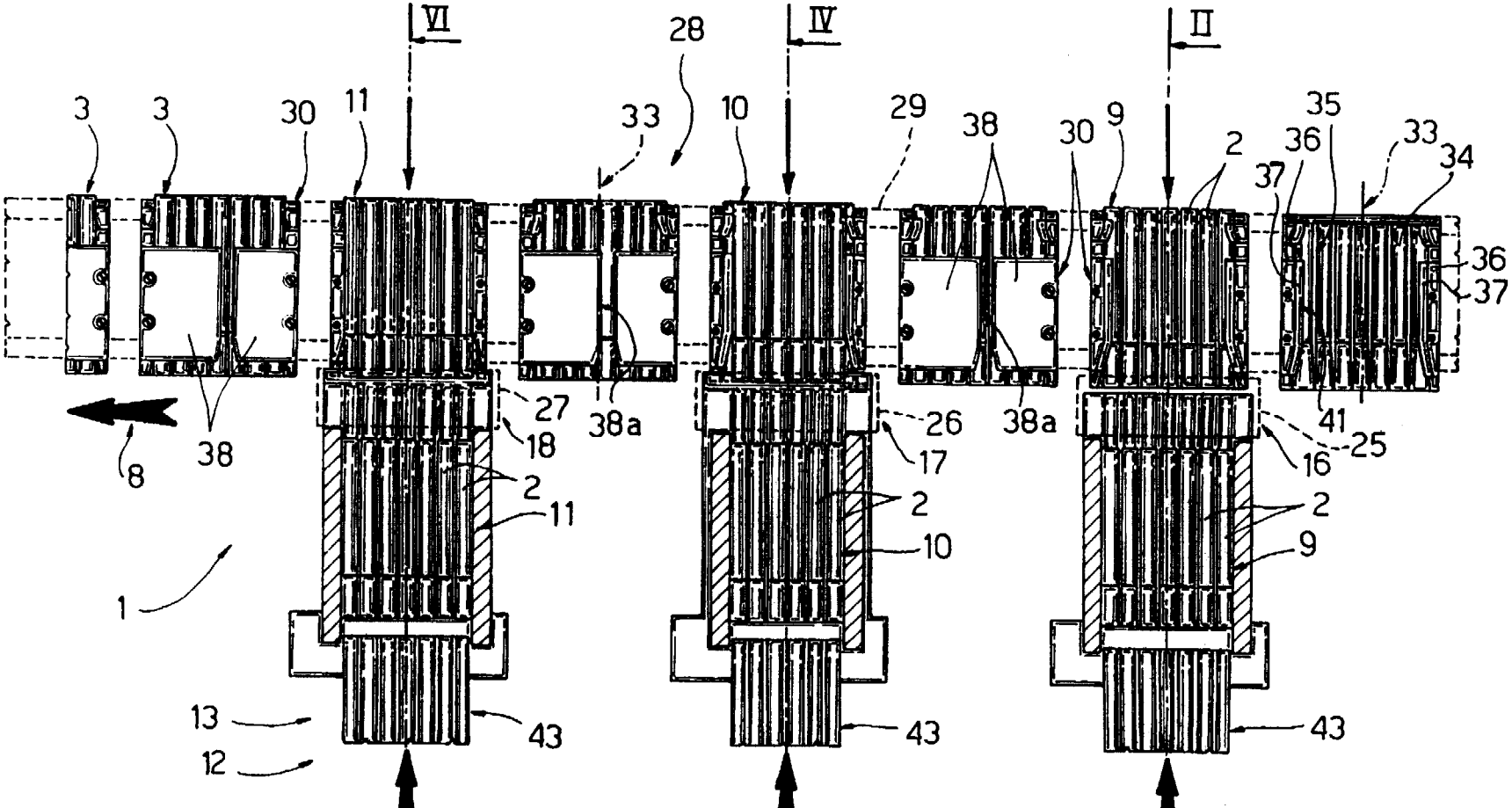
FIG. 1 shows a schematic plan view, with parts in section and parts removed for clarity, of the input portion of a cigarette packing line implementing the method according to the present invention.
Figures 10, 11:
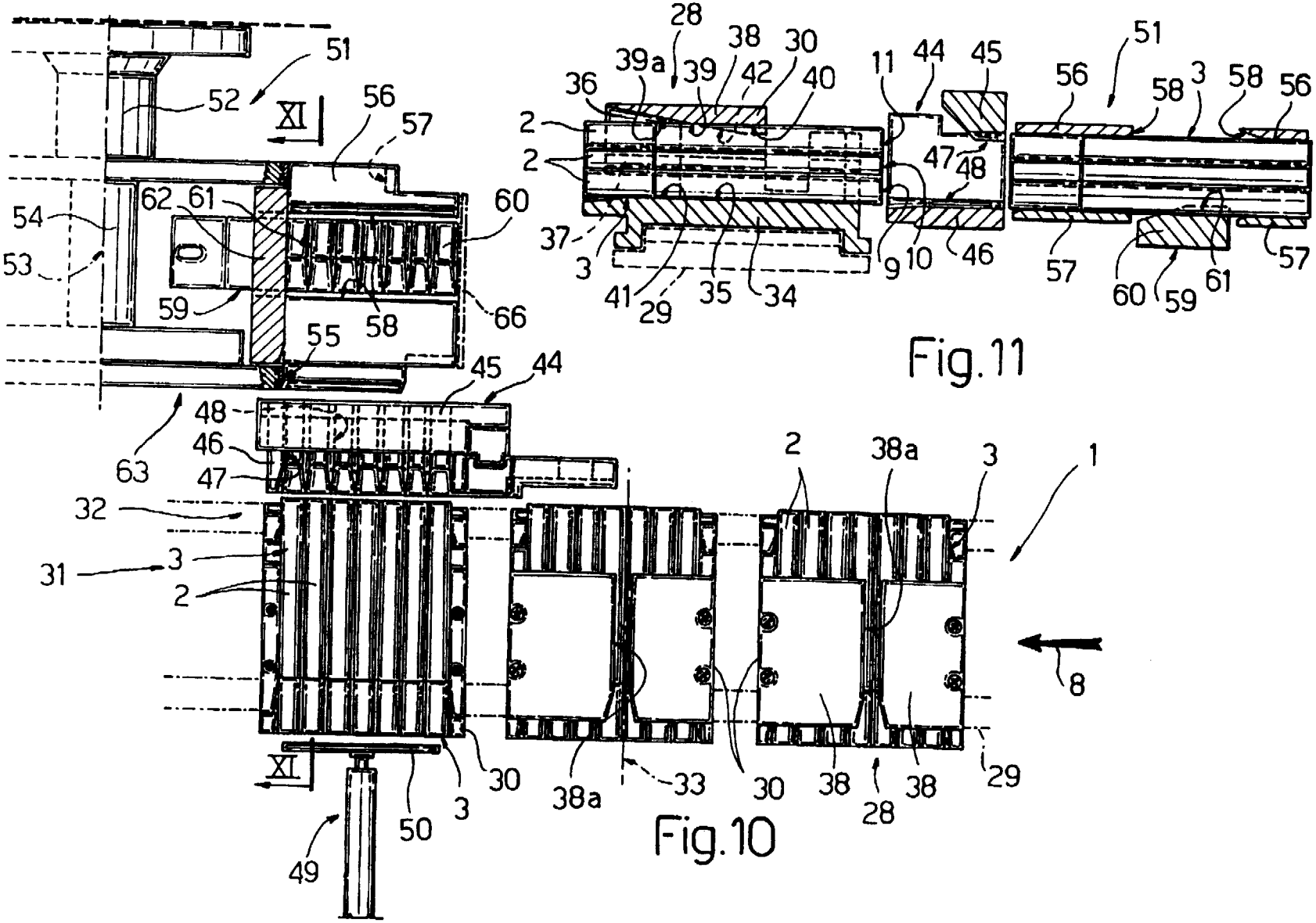
FIG. 10 shows a schematic plan view, with parts in section and parts removed for clarity, of a first portion of the output portion of the packing line in FIG. 1.
FIG. 11 shows a larger-scale section along line XI—XI in FIG. 10.
Figure 12:
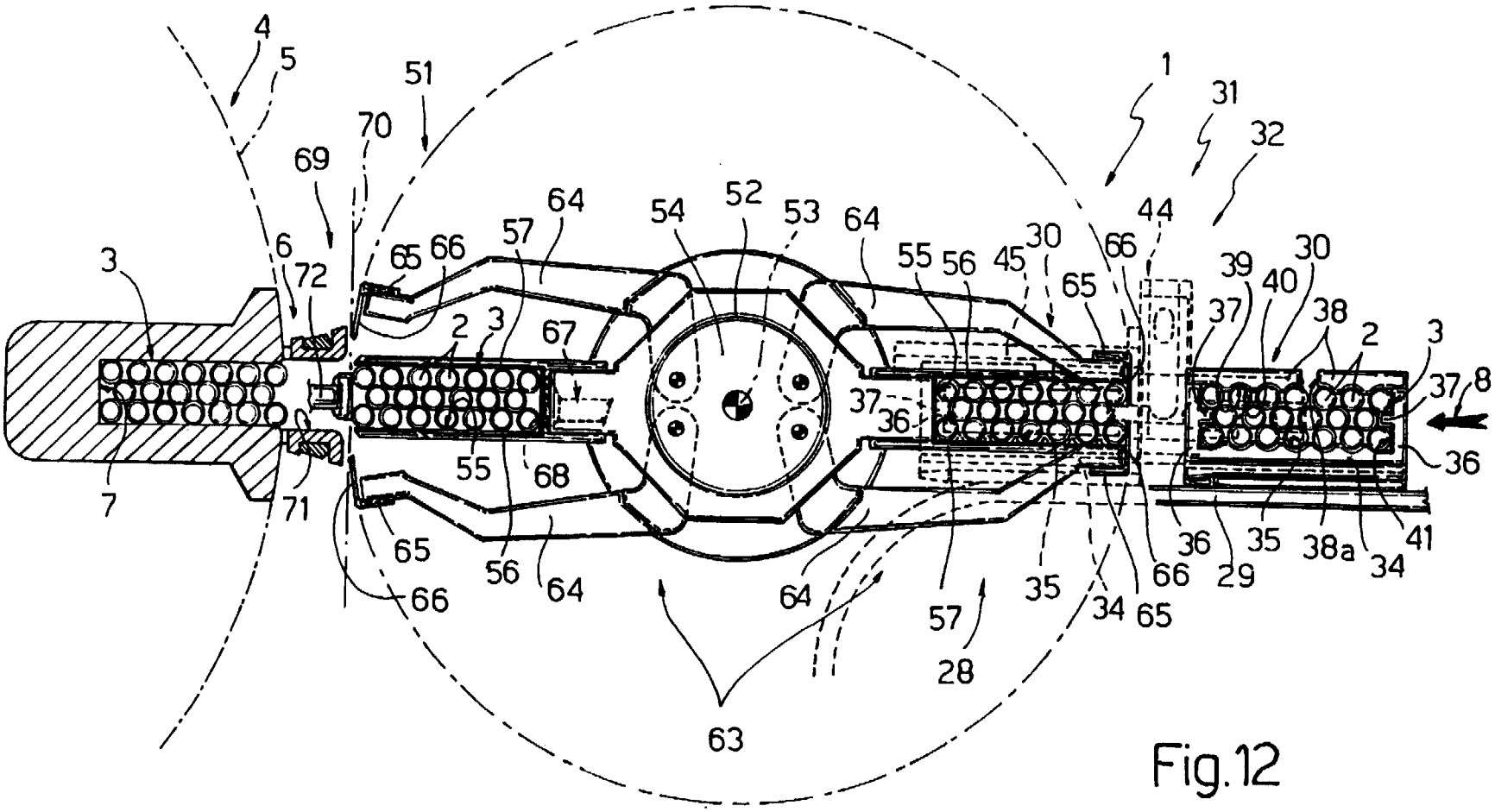
FIG. 12 shows a schematic side view, with parts removed for clarity, of a second portion of the output portion of the packing line in FIG. 1.

Number 1 in FIGS. 1, 10 and 12 indicates a line for packing cigarettes 2 in groups 3. Line 1 constitutes the input line of a wrapping machine 4, the wrapping wheel 5 of which, downstream from the output station 6 of line 1, comprises a number of peripheral seats 7 equally spaced about the axis of rotation (not shown) of wheel 5, which is substantially perpendicular to the traveling direction 8 of groups 3 along line 1.

Each group 3 comprises a given number of cigarettes 2 divided into flat, parallel, superimposed layers offset in relation to one another to define a so-called quincunx structure in which each layer is defined by a number of loosely packed cigarettes 2, i.e. arranged side by side with such a spacing P1 that the cigarettes 2 in each layer are equally spaced by a distance of other than zero and less than their diameter. In the example shown, each group 3 comprises twenty cigarettes 2 arranged in three horizontal, superimposed layers indicated 9, 10, 11 from the bottom.

Figures 2, 8, 9:
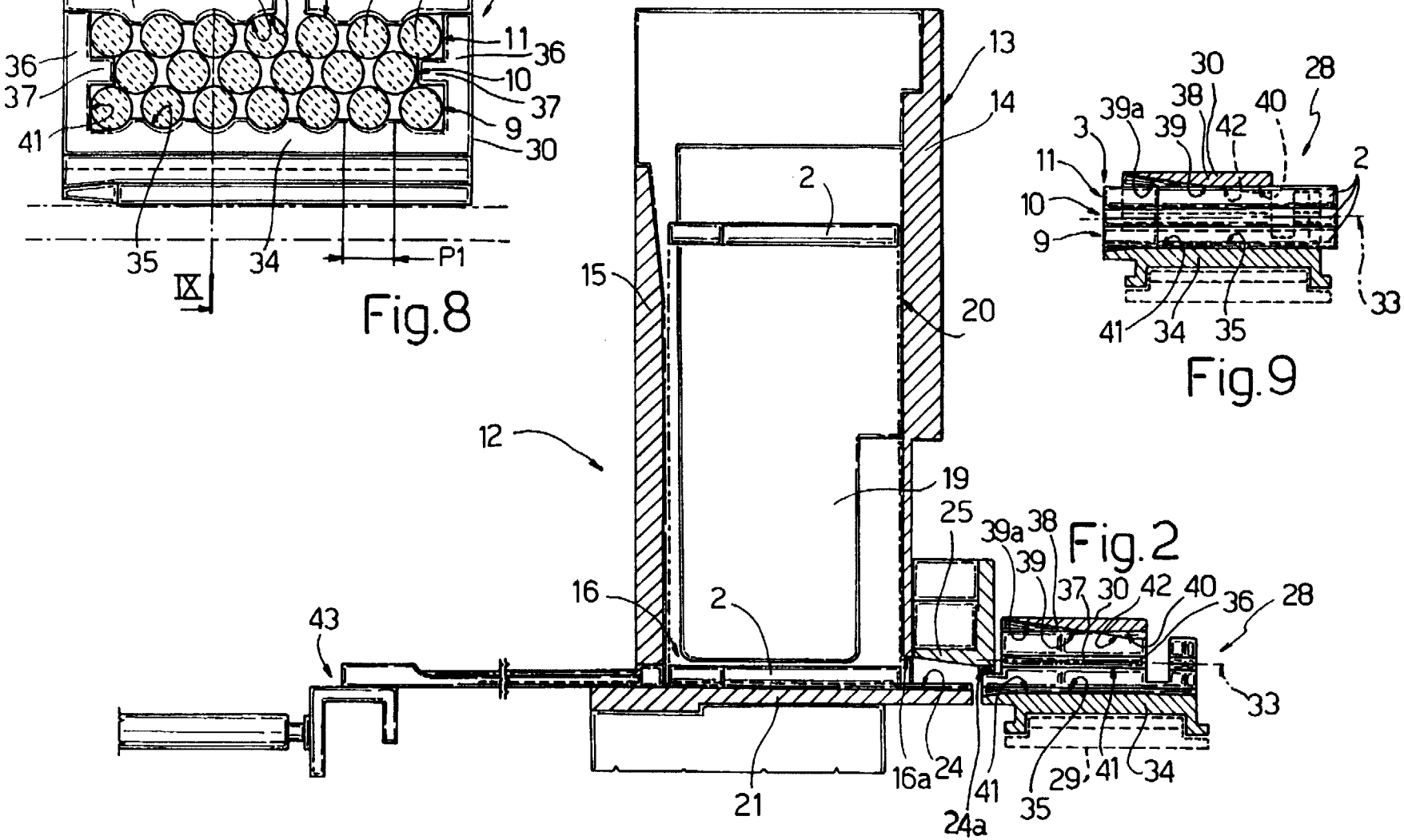
FIG. 2 shows a section along line II—II in FIG. 1.
FIG. 8 shows a larger-scale side view, with parts removed for clarity, of a detail in FIG. 1.
FIG. 9 shows a smaller-scale section along line IX—IX in FIG. 8.
Figure 3A:
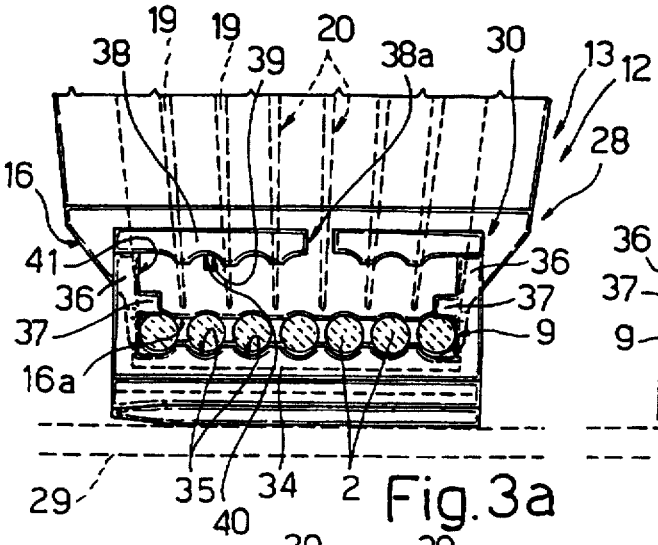
FIG. 3 shows a larger-scale side view, with parts removed for clarity, of a detail in FIG. 2.
Figure 3B:
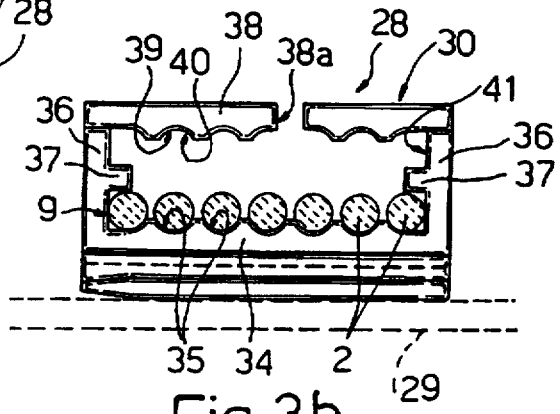
Figure 5A:
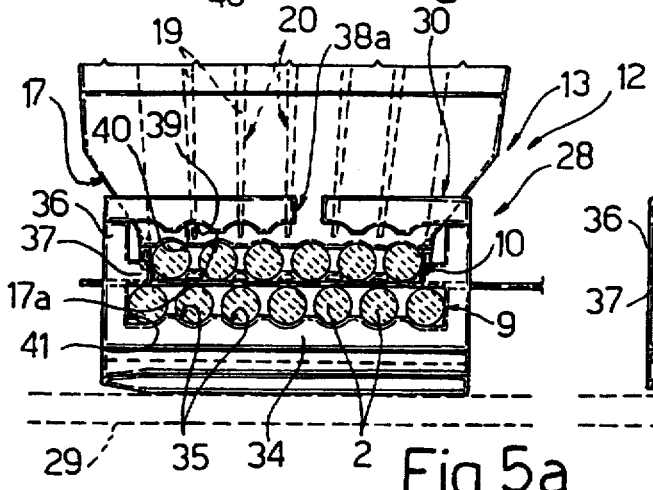
FIG. 5 shows a larger-scale side view, with parts removed for clarity, of a detail in FIG. 4.
Figure 5B:
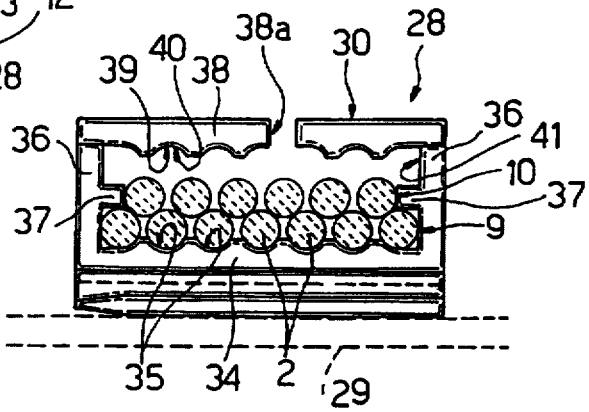
Figure 7A:
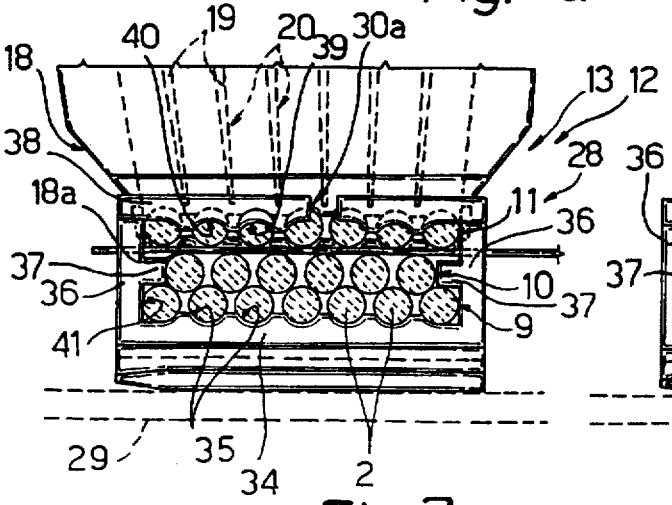
FIG. 7 shows a larger-scale side view, with parts removed for clarity, of a detail in FIG. 6.
Figure 7B:
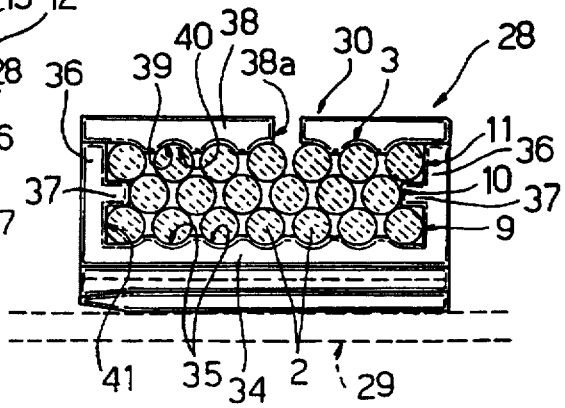
Figure 6:
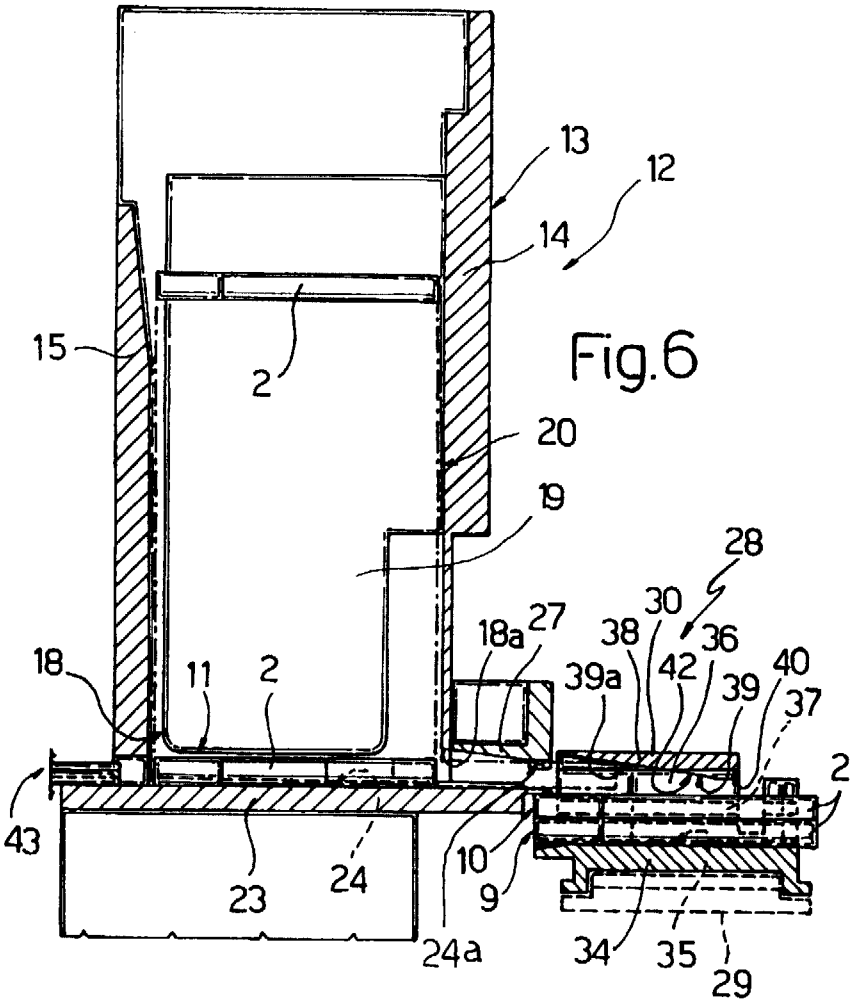
FIG. 6 shows a section along line VI—VI in FIG. 1.
Figure 4:
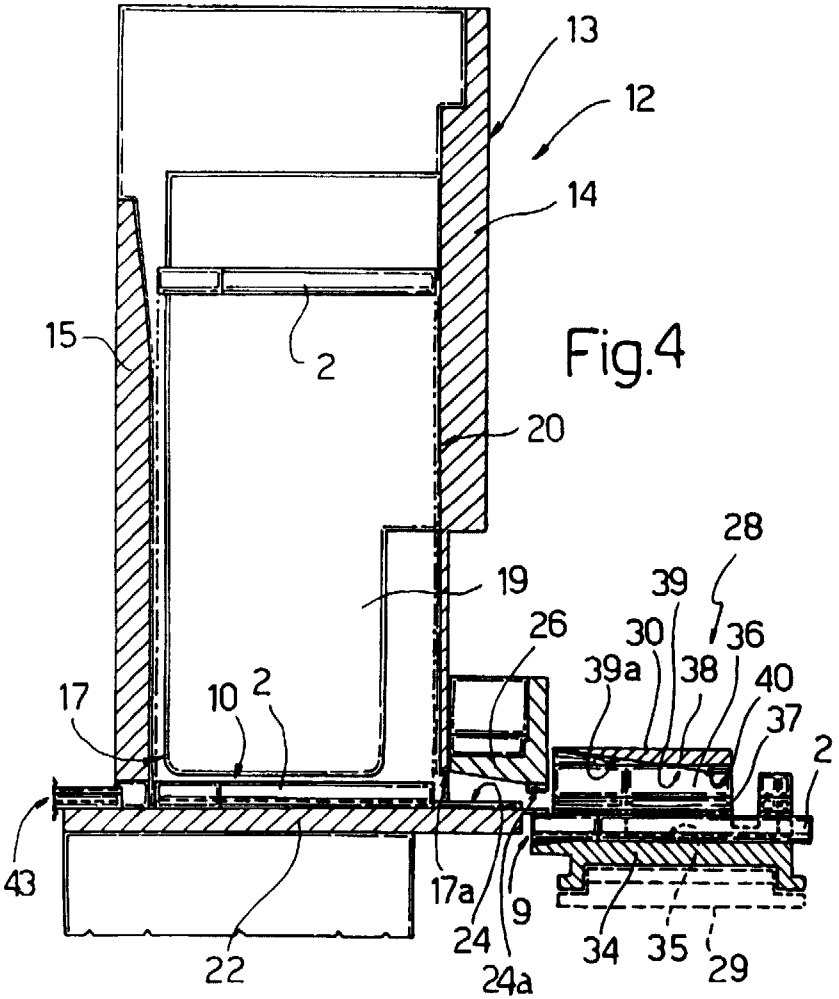
FIG. 4 shows a section along line IV—IV in FIG. 1.

Line 1 comprises a unit 12 for forming groups 3, and the input of which is defined by a feedbox 13 (shown partly in FIGS. 2, 4, 6) presenting a front and rear wall 14, 15 substantially parallel to direction 8 and between which cigarettes 2, stacked with their respective longitudinal axes substantially perpendicular to direction 8, drop down towards three outlets 16, 17, 18 aligned with one another in direction 8 and equally spaced by spacing P2.

Each outlet 16, 17, 18 presents a number of substantially vertical inner walls 19 perpendicular to walls 14 and 15, and which divide the relative outlet 16, 17, 18 into a number of substantially vertical channels 20 of a width approximately equal to but no less than the diameter of cigarettes 2, and along each of which travels a column of superimposed cigarettes 2. Channels 20 of outlets 16, 17, 18 provide for successively feeding cigarettes 2 by gravity on to respective substantially horizontal plates 21, 22, 23, which present respective transverse grooves equally spaced in direction 8 by spacing P1, and each defining a seat 24 located beneath the bottom end of a respective channel 20, for receiving a respective cigarette 2 and retaining it in position crosswise to its axis. More specifically, channels 20 of outlets 16, 17, 18, and the corresponding seats 24 on plates 21, 22, 23 are of such a number and are so arranged that the layers of cigarettes 2 formed by gravity on plates 21, 22, 23 correspond to layers 9, 10, 11, and come out of respective outlets 16, 17, 18 through respective openings 16*a*, 17*a*, 18*a* formed through wall 14 at the front end of plates 21, 22, 23.

Each outlet 16, 17, 18 presents a respective guide plate 25, 26, 27 fitted integral with the outer surface of wall 14 over respective opening 16*a*, 17*a*, 18*a*, and presenting respective downward-facing grooves 24*a* facing corresponding seats 24 to define, together with respective plate 21, 22, 23, a guide for the respective layer 9, 10, 11 on respective plate 21, 22, 23.

As shown in FIGS. 1 and 10, line 1 comprises a pocket conveyor 28 extending in direction 8 in front of openings 16*a*, 17*a*, 18*a*, and in turn comprising an endless belt 29 supporting in known manner a succession of pockets defined by respective tubular spindles spaced with spacing P2. Internally, each spindle 30 defines a hollow volume of given size and for housing to size a group 3 of cigarettes 2, as explained in more detail later on. Conveyor 28 feeds spindles 30 in steps in direction 8, so that each spindle 30 successively faces openings 16*a*, 17*a*, 18*a*; and conveyor 28 is connected to wrapping wheel 5 by a transfer unit 31 (FIG. 12) extending between a transfer station 32, arranged crosswise to direction 8 at the output end of conveyor 28, and station 6, and which provides for successively transferring groups 3 from spindles 30 to respective pockets 7 on wrapping wheel 5.

Each spindle 30 presents a longitudinal axis 33 crosswise to direction 8, a length shorter than that of cigarettes 2, and a substantially rectangular cross section defined at the bottom by a substantially horizontal bottom wall 34 presenting, on top, grooved seats 35 arranged with spacing P1 and for housing bottom layer 9. Spindle 30 is defined laterally by two lateral walls 36 perpendicular to wall 34 and each presenting a central longitudinal inner rib 37 of a thickness, measured crosswise to wall 36, substantially equal to the radius of cigarette 2. Spindle 30 is defined at the top by a wall 38 divided into two parts by a central longitudinal opening 38*a*, and presenting an inner surface 39 substantially parallel to wall 34 and comprising an input portion 39*a* facing feedbox 13 and sloping towards wall 34 and inwards of spindle 30. Surface 39 presents a number of grooves or seats 40 arranged with spacing P1, engaged respectively by a cigarette 2 in layer 11, and each comprising an input portion extending along portion 39*a* and sloping in relation to wall 34.

Together with wall 38, walls 34 and 36 define a chamber 41 with substantially the same section as a packet (not shown) to be filled with group 3, and presenting a tapered inlet 42 facing feedbox 13.

As shown more clearly in FIG. 1, for each outlet 16, 17, 18, feedbox 13 comprises a pusher 43 located on the opposite side of respective outlet 16, 17, 18 to conveyor 28, and which, by means of a linear actuator, is moved crosswise to direction 8, between an idle and an extracted position to transfer the corresponding layer 9, 10, 11 from respective plate 21, 22, 23 into a spindle 30 facing outlet 16, 17, 18.

The upper surfaces of plates 21, 22, 23 of outlets 16, 17, 18 are parallel but not coplanar with one another. More specifically, the upper surface of plate 21 is substantially coplanar with the plane along which the upper surface of bottom walls 34 of spindles 30 travels, while the upper surfaces of plates 22 and 23 are located at different levels, each higher than that of the upper surface of plate 21. The difference in the level of the upper surface of plate 22 and the upper surface of each of plates 21 and 23 is approximately equal to but no greater than the diameter of cigarette 2, and seats 24 of plate 22 are offset in relation to those of plates 21 and 23 by a distance equal to the radius of cigarette 2.

Unit 31 also comprises a tubular body 44 extending crosswise to direction 8 at station 32, and which is defined at the top and bottom by two walls 45, 46 presenting respective grooves or seats 47, 48 similar to seats 35 and 40 and also arranged with spacing P1, so that tubular body 44 presents substantially the same section as chamber 41 of spindles 30. Tubular body 44 is located on the opposite side of conveyor 28 in relation to feedbox 13 and in relation to a pusher 49, which comprises a blade 50 movable back and forth through a stationary spindle 30 at station 32 and through tubular body 44 to transfer group 3 from spindle 30 to a known turnover device 51 immediately upstream from wrapping wheel 5.

Turnover device 51 is moved in steps of 180° and in time with conveyor 28 by a drive shaft 52 rotating about a central axis 53 substantially coplanar with the axes 33 of spindles 30 traveling, in use, towards station 32. Turnover device 51 comprises a central hub 54 presenting two diametricallyopposed pockets 55, the inner volume of which is substantially equal to that defined by spindles 30; and each pocket 55 is defined by two parallel plates 56 and 57 extending radially outwards from hub 54, and each presenting a radial through opening 58, so that the two openings 58 of each pocket 55 define a passage for a fixed guide element 59 in station 32.

As shown in FIG. 11, element 59 comprises a wall 60 coplanar and aligned with wall 46, and which, on top, presents grooves 61 arranged with spacing P1 and aligned with corresponding grooves 48 in wall 46. Element 59 also comprises a fixed wall 62 extending vertically from the end of wall 60 facing hub 54, and in the gap between plates 56 and 57.

For each pocket 55, turnover device 51 also comprises a retaining device 63 in turn comprising two arms 64, which, by means of a known actuating device (not shown), are moved in pincer fashion between a closed position shown to the right in FIG. 12, and an open position shown to the left in FIG. 12. Each arm 64 presents a substantially L-shaped end blade 65, the end arm 66 of which defines, with the other arm 66, the outer lateral wall of respective pocket 55 when this is stationary in station 32 and retaining device 63 is in the closed position in which arms 66 are coplanar with each other and parallel to axis 53.

Turnover device 51 also comprises a pusher 67 fixed inside hub 54 at station 6, and presenting a flat wall 68 movable back and forth radially in relation to hub 54 and between a withdrawn position, in which wall 68 is symmetrical with wall 62 in relation to axis 53 and defines the inner lateral wall of a stationary pocket 55 in station 6, and an extracted position, in which wall 68 is located outwards of the outer end of said pocket 55 and substantially tangent to the outer periphery of wrapping wheel 5.

As it moves between said withdrawn and extracted positions, wall 68 crosses a line 69 for supplying wrapping material 70 and tangent to turnover device 51 at station 6, and travels along a channel 71 connecting said pocket 55 at station 6 to a corresponding pocket 7 on wrapping wheel 5.

Wheel 5 is provided with a counter-pusher 72 movable at station 6 between an extracted position (FIG. 12) in which it contacts a group 3 housed inside a respective stationary pocket 55 at station 6, and a withdrawn position (not shown) in which counter-pusher 72 is aligned with the end of the stationary pocket 7 in station 6.

In actual use, cigarettes 2 inside feedbox 13 engage channels 20 of outlets 16, 17, 18 by gravity to define, on plates 21, 22, 23, layers 9, 10, 11, each comprising cigarettes, 2 arranged side by side with spacing P1; and each layer 9, 10, 11 is fed successively by respective pusher 43 into a tubular spindle 30 arrested in front of respective outlet 16, 17, 18.

As regards layer 9, the alignment of seats 24 of plate 21 and seats 35 of spindle 30 enables cigarettes 2 in layer 9 to be arranged in the operating position with spacing P1, and to be maintained in this position as and once they are fed into spindle 30. As seats 24 of plate 22 are aligned with the seats defined inside spindle 30 by adjacent pairs of cigarettes 2 in layer 9, the same also applies to the cigarettes 2 in layer 10; and, as seats 24 of plate 23 are aligned with the seats defined inside spindle 30 by adjacent pairs of cigarettes 2 in layer 10 and by seats 40 in wall 38 of spindle 30, the same also applies to the cigarettes 2 in layer 11.

Moreover, on account of inclined portion 39*a* of inner surface 39 of wall 38, and the larger curve radius of seats 35 and 40 as compared with that of cigarettes 2, layers 9, 10, 11 are compressed against one another in a first direction perpendicular to them, so that the cigarettes 2 in each layer penetrate further between those in each adjacent layer, and each layer 9, 10, 11 is therefore also compressed in a second direction parallel to axis 33.

As a tubular spindle 30 housing a complete group 3 reaches transfer station 32, conveyor 28 is arrested; turnover device 51 presents a stationary empty pocket 55 at station 32; and respective device 63 is in the closed position. At this point, group 3 is transferred by pusher 49 from spindle 30 into pocket 55, and internally grooved tubular body 44 and grooved guide element 59 ensure that, as and once they are fed into pocket 55, the cigarettes 2 in group 3 are maintained in the quincuncial arrangement with spacing P1 despite pocket 55 presenting no internal grooves.

At this point, turnover device 51 moves pocket 55 over to output station 6 and into a position facing channel 71; retaining device 63 is opened; and fixed wall 62 is gradually replaced by wall 68 of pusher 67. Once station 6 is occupied by pocket 55, counter-pusher 72 replaces arms 66 of device 63 to maintain the arrangement of group 3 inside pocket 55 and to position wrapping material 70 on the cigarettes 2 of group 3 facing wheel 5; and pusher 67 and counter-pusher 72 are operated simultaneously to transfer group 3 and material 70 along channel 71 into a stationary pocket 7 at output station 6.

We claim:

1. A method of forming and conveying orderly groups of elongated products, the method comprising:

forming a said group by confining a number of superimposed layers of products, including a bottom layer, inside a given volume, each layer comprising a number of products arranged, inside said volume, in an orderly operating arrangement wherein the products in each layer are arranged side by side and separated by a given distance greater than zero and less than the width of the product, each pair of adjacent products in each layer defining a seat for a product in each adjacent layer;

feeding the layers axially into a forming spindle to form each group, the spindle defining said given volume;

transversely retaining, in said operating arrangement, the products in at least said bottom layer inside said given volume, the spindle comprising a bottom wall having seats separated by said given distance for receiving and transversely retaining in position the products of said bottom layer;

compressing each group inside said given volume in a direction crosswise to the layers, and in a direction parallel to the layers and crosswise to the products; and feeding said volume to wrapping means in a given supply direction.

2. A method as claimed in claim 1, wherein each group is formed by feeding the layers axially and successively into said spindle.

3. A method as claimed in claim 2, further comprising an initial step of forming each said layer by arranging the relative products in said operating arrangement wherein the products are separated by said given distance; each layer so formed being fed into the relative said spindle by guiding the relative said products in such a manner as to maintain said operating arrangement.

4. A method as claimed in claim 1, further comprising a step of feeding each spindle crosswise to the products in the relative group and in said supply direction by means of first conveying means; unloading each said group from the relative said spindle in an axial direction in relation to the relative said products; and transferring the group into a further pocket of further conveying means; each group being fed into the relative further pocket by guiding the products in at least one of the layers in such a manner as to maintain the group in said operating arrangement.

5. A line for forming and conveying orderly groups of elongated products, the line comprising at least a first conveyor traveling in a given supply direction towards wrapping means and including pockets, each defining a given volume for accommodating a said group, each group comprising a number of superimposed layers of products including a bottom layer; and supply means including first thrust means for feeding the layers in each said group axially into the relative said volume; each said pocket comprising retaining means for transversely retaining the products of said layers inside the relative said volume and in an operating arrangement wherein the products in each layer are arranged side by side and separated by a given distance greater than zero and less than the width of the product so that each pair of adjacent products in said operating arrangement defines, in use, a seat for a product in each adjacent layer, said pocket being defined by a forming spindle in turn defining said given volume; the spindle having a bottom wall, and said retaining means comprising seats provided on said bottom wall and separated by said given distance for receiving and transversely retaining in position the products of said bottom layer; and compressing means for compressing each group inside said given volume in a direction crosswise to the layers, and in a direction parallel to the layers and crosswise to the products.

6. A line as claimed in claim 5, wherein said first thrust means comprise a number of push means equal in number to said layers and each operating on a respective said layer; said push means being operated successively to feed the respective layers successively into a respective said pocket.

7. A line as claimed in claim 6, wherein said supply means comprise a feedbox for said products, the feedbox having a number of outlets equal in number to said layers; and a bottom plate located beneath a respective said outlet to receive the products of a respective said layer; each said bottom plate being provided with guide means for maintaining the products in the relative layer separated by said given distance.

8. A line as claimed in claim 5, wherein each said seat is of such a width as to receive a respective said product in a transversely slack manner.

9. A line as claimed in claim 5, further comprising a second conveyor in series with the first conveyor and located between the first conveyor and said wrapping means; the second conveyor comprising at least one pocket alignable with a pocket on the first conveyor at a transfer station; second thrust means being provided at the transfer station for transferring a group from inside a pocket on the first conveyor into a pocket on the second conveyor and crosswise to said supply direction; and at least a first fixed guide element being interposed between the two pockets at said transfer station, to guide, in use, the products in at least one layer of the group being transferred between the two pockets, so that the group is maintained in said operating arrangement.

10. A line as claimed in claim 9, further comprising a second fixed guide element located at the pocket of the second conveyor and in said transfer station, for guiding, in use, the products of at least one layer of the group being transferred between the two pockets, so that the group is maintained in said operating arrangement as it is inserted inside the pocket on the second conveyor.

11. A method of forming and conveying orderly groups of elongated products, each group comprising a predetermined number of superimposed layers of products, and the method comprising;

step-advancing a forming spindle through layer-feeding stations equal in number to said layers, said spindle having an internal volume to accommodate a respective said group;

step-forming said group inside said volume by feeding the layers axially and successively into said spindle, each layer being fed axially into said spindle at the respective layer-feeding station; and feeding said volume to wrapping means in a given supply direction; each layer comprising a number of products arranged, inside said volume, in an orderly operating arrangement wherein the products in each layer are arranged side by side and separated by a given distance greater than zero and less than the width of the product; each pair of adjacent products in each layer defining a seat for a product in each adjacent layer.

12. A method as claimed in claim 11, further comprising the step of transversely retaining, in said operating arrangement, the products in at least one outer layer of said group inside said given volume.

13. A method as claimed in claim 11, further comprising the step of compressing each group inside said given volume in a first direction crosswise to the layers, and in a second direction parallel to the layers and crosswise to the products.

14. A method as claimed in claim 11, wherein said group comprises a bottom layer; the method further comprising the step of transversely retaining, in said operating arrangement, the products in said bottom layer inside said volume, the spindle comprising a bottom wall in turn comprising seats separated by said given distance and for receiving and transversely retaining in position the products of said bottom layer.

15. A method as claimed in claim 11, further comprising the initial step of forming each said layer by arranging the relative products in said operating arrangement wherein the products are separated by said given distance, each layer so formed being fed into the relative said spindle by guiding the relative said products in such a manner as to maintain said operating arrangement.

16. A method as claimed in claim 11, further comprising the step of feeding each spindle crosswise to the products in the relative group and in said supply direction by means of first conveying means; unloading each said group from the relative said spindle in an axial directions in relation to the relative said products, and transferring the group into a further pocket of further conveying means; each group being fed into the relative further pocket by guiding the products in at least one of the layers in such a manner as to maintain the group in said operating arrangement.

17. A line of forming and conveying orderly groups of elongated products, the line comprising a first conveyor having a number of pockets and step-movable in a supply direction towards wrapping means, each said pocket defining a given volume for accommodating a respective said group, and each group comprising a number of superimposed layers of products; a plurality of layer supply stations arranged along said first conveyor and each provided with respective layer-supply means for feeding a respective said layer into said volume; each said pocket comprising retaining means for transversely retaining the products inside the relative said volume and in an operating arrangement wherein the products in each layer are arranged side by side and separated by a given distance greater than zero and less than the width of the product; each pair of adjacent products in said operating arrangement defining, in use, a seat for a product in each adjacent layer.

18. A line as claimed in claim 17, wherein said supply direction extends transversely to said elongated products in each group.

19. A line as claimed in claim 17, further comprising compressing means for compressing each group inside said given volume in a first direction crosswise to the layers, and in a second direction parallel to the layers and crosswise to the products.

20. A line as claimed in claim 17, wherein said layer-supply means comprise first thrust means for feeding a respective layer axially into a respective said pocket.

21. A line as claimed in claim 20, wherein said supply means comprise an outlet for the products of a respective said layer; and a bottom plate located beneath said outlet to receive the products of the respective said layer; said bottom plate including guide means for maintaining the products in the relative layer separated by said given distance.

22. A line as claimed in claim 17, wherein each said pocket is defined by a forming spindle in turn defining said given volume; the spindle comprising a bottom wall provided with seats separated by said given distance and for receiving and transversely retaining in position the products in a first said layer.

23. A line as claimed in claim 22, wherein each said seat is of such a width as to receive a respective said product in a transversely slack manner.

24. A line as claimed in claim 17, further comprising a second conveyor in series with the first conveyor and located between the first conveyor and said wrapping means; the second conveyor comprising at least-one pocket alignable with a pocket on the first conveyor at a transfer station; second thrust means being provided at the transfer station for transferring a group from inside a pocket on the first conveyor into a pocket on the second conveyor and crosswise to said supply direction; and at least a first guide element being interposed between the two pockets at said transfer station to guide, in use, the products in at least one layer of the group being transferred between the two pockets, so that the group is maintained in said operating arrangement.

25. A line as claimed in claim 24, further comprising a second fixed guide element located at the pocket of the second conveyor and in said transfer station, for guiding, in use, the products of at least one layer of the group being transferred between the two pockets, so that the group is maintained in said operating arrangement as it is inserted inside the pocket on the second conveyor.

* * * * *

UNITED STATES PATENT AND TRADEMARK OFFICE

CERTIFICATE OF CORRECTION

PATENT NO. : 5,782,334

DATED : July 21, 1998

INVENTOR(S) : Gian Paolo Parrocchetti, et al.

It is certified that error appears in the above-identified patent and that said Letters Patent is hereby corrected as shown below:

ON THE TITLE PAGE:

Item [30] change "Jan. 26, 1995" to --Jan. 27, 1995 --

Signed and Sealed this

Twenty-ninth Day of December, 1998

*Attest:*

Bruce Lehman

BRUCE LEHMAN

*Attesting Officer*

*Commissioner of Patents and Trademarks*